US006773095B2

(12) United States Patent
Isono

(10) Patent No.: US 6,773,095 B2
(45) Date of Patent: Aug. 10, 2004

(54) INKJET PRINT HEAD

(75) Inventor: Jun Isono, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 83 days.

(21) Appl. No.: 10/263,698

(22) Filed: Oct. 4, 2002

(65) Prior Publication Data

US 2003/0067510 A1 Apr. 10, 2003

(30) Foreign Application Priority Data

Oct. 4, 2001 (JP) ..... 2001-308400

(51) Int. Cl.[7] ..... B41J 2/045
(52) U.S. Cl. ..... 347/72
(58) Field of Search ..... 347/68, 70–72; 310/328; 29/890.1

(56) References Cited

U.S. PATENT DOCUMENTS 5,402,159 A * 3/1995 Takahashi et al. ..... 347/9
6,595,628 B2 * 7/2003 Takagi et al. ..... 347/72
6,688,732 B2 * 2/2004 Mitsuhashi et al. ..... 347/70
2003/0067510 A1 * 4/2003 Isono ..... 347/68

* cited by examiner

*Primary Examiner*—Judy Nguyen
(74) *Attorney, Agent, or Firm*—Oliff & Berridge, PLC

(57) ABSTRACT

An inkjet print head includes a piezoelectric actuator configured of stacked piezoelectric sheets with individual electrodes formed on the piezoelectric sheets. Positioning marks formed of the same material as the individual electrodes are formed one in each of the four corners of the piezoelectric sheets. A beam of light is radiated on the positioning marks in the stacked direction of the piezoelectric sheets, forming shadows of the positioning marks in each corner. The shadows are detected, and the center of gravity is determined for each shadow. Diagonal lines are drawn between the centers of gravity in opposing corners. The intersecting point of the diagonal lines serves as a reference point for bonding the piezoelectric actuator to the stacked cavity unit.

21 Claims, 12 Drawing Sheets

10
X
Y
UP
DOWN
14
14a
16
13
17
18
19a
19b
12X
12a
12Y
12b
11
15

INKJET PRINT HEAD

BACKGROUND OF THE INVENTION

1. Field of the Invention

The present invention relates to an inkjet print head.

2. Description of Related Art

An on-demand piezoelectric type inkjet print head well known in the art, includes: a cavity unit having a plurality of nozzles and a plurality of pressure chambers, each corresponding to one nozzle; and a plate-shaped piezoelectric actuator formed of stacked piezoelectric sheets (green sheets manufactured of a ceramic material) alternately having individual electrodes formed for each pressure chamber and common electrodes common to a plurality of neighboring pressure chambers. This piezoelectric actuator has to be superimposed on the cavity unit so that each individual electrode in the actuator will correspond to an individual pressure chamber.

In order to assemble the piezoelectric actuator with the cavity unit, which is made of metal materials and the like, marks are previously formed on the peripheral surface of the stacked green sheets, before the green sheet stack is sintered. After sintering, a resultant piezoelectric actuator is located on the cavity unit by aligning the marks on the peripheral surface of the piezoelectric actuator with prescribed positions on the cavity unit.

SUMMARY OF THE INVENTION

It is noted, however, that the step for sintering the green sheet causes the green sheet to shrink, thereby decreasing the pitch between individual electrodes formed on the piezoelectric sheets. For this reason, shrinkage is taken into account when manufacturing green sheets used to produce the piezoelectric sheets. Despite this, the amount of shrinkage is different in the center and peripheral portions of the sheets. Further, the amount of shrinkage is different according to the position in the sintering furnace. Accordingly, when assembling the piezoelectric actuator with the cavity unit, even by aligning the preformed marks on the piezoelectric actuator with the prescribed positions on the cavity unit, the individual electrodes will not be in line with the pressure chambers in the cavity unit.

In order to solve this problem, it is conceivable to provide a print head as shown in FIG. 1.

The conceivable print head includes: a cavity unit 54 and a plate-shaped piezoelectric actuator 56. The cavity unit 54 has a plurality of pressure chambers 55 and a plurality of nozzles (not shown), each of which is in fluid communication with a corresponding pressure chamber 55. The plate-shaped piezoelectric actuator 56 is formed of piezoelectric sheets (green sheets manufactured of a ceramic material) 50 stacked alternately with individual electrodes 51 (FIG. 2) and common electrodes (not shown).

FIG. 2 shows one of several piezoelectric sheets 50, on which the individual electrodes 51 are provided. As shown in FIG. 2, a plurality of individual electrodes 51 are arranged in rows along the long sides of the piezoelectric sheet 50. One centrally-located individual electrode 51 on each side of the piezoelectric sheet 50 is replaced by an elongated electrode 52 having an extended part 52*a* that extends to the outer edge of the piezoelectric sheet 50. The extended part 52*a* is used to determine the position of the individual electrodes 51 externally.

As shown in FIG. 1, positioning marks 54*a* are provided on the cavity unit 54. When assembling the piezoelectric actuator 56 and the cavity unit 54, the extended parts 52*a* are aligned with the positioning marks 54*a* in order to align each individual electrode 51 accurately with one pressure chamber 55.

It is, however, difficult to accurately discern the extended parts 52*a* of the electrodes 52 exposed on the side surfaces of the piezoelectric actuator 56, due to the extremely thin shape of the electrodes 52.

In view of the above-described drawbacks, it is an objective of the present invention to provide an improved inkjet print head, which is capable of facilitating an accurate alignment of individual electrodes in the piezoelectric actuator to pressure chambers in the cavity unit when assembling the piezoelectric actuator and cavity unit. It is another object to provide an improved method of producing an inkjet print head.

In order to attain the above and other objects, the present invention provides an inkjet print head comprising: a cavity unit having a plurality of nozzles and a plurality of pressure chambers which are provided in one-to-one correspondence with the plurality of nozzles; and a piezoelectric actuator provided over the cavity unit, the piezoelectric actuator including: a plurality of piezoelectric sheets which are stacked one on another, each piezoelectric sheet being elongated over the plurality of pressure chambers; a plurality of individual electrodes provided on each of several ones of the plurality of piezoelectric sheets; and at least one detecting portion, formed on each of the several piezoelectric sheets, for being used to detect the position of the individual electrodes by being irradiated with light along the stacked direction of the piezoelectric sheets, the piezoelectric actuator and the cavity unit being positioned relative to each other using the at least one detecting portion on each of the several piezoelectric sheets, thereby allowing each individual electrode to be located substantially at a position corresponding to one pressure chamber.

According to another aspect, the present invention provides an inkjet print head comprising: a cavity unit having a plurality of nozzles and a plurality of pressure chambers which are provided in one-to-one correspondence with the plurality of nozzles; and a piezoelectric actuator provided over the cavity unit, the piezoelectric actuator including: a plurality of piezoelectric sheets which are stacked one on another, each piezoelectric sheet being elongated over the plurality of pressure chambers; a plurality of individual electrodes provided between at least two adjacent ones of the plurality of piezoelectric sheets; and at least one detecting portion, formed on at least one of the plurality of piezoelectric sheets, for being used to detect the position of the individual electrodes by being irradiated with light along the stacked direction of the piezoelectric sheets, the piezoelectric actuator and the cavity unit being positioned relative to each other using the at least one detecting portion, thereby allowing each individual electrode being located substantially at a position corresponding to one pressure chamber.

According to a further aspect, the present invention provides an inkjet print head, comprising: a cavity unit which is elongated in a lengthwise direction, the cavity unit having a plurality of pressure chambers arranged in one row, the cavity unit being provided with two cavity-unit detecting portions, which are arranged along the lengthwise direction and which are located on both ends of the elongated cavity unit in the lengthwise direction; and a piezoelectric actuator provided over the cavity unit, the piezoelectric actuator including: a plurality of piezoelectric sheets, a plurality of groups of individual electrodes, and a plurality of common electrodes, which are alternately stacked on one another, each piezoelectric sheet being elongated over the plurality of pressure chambers, each common electrode being elongated over the plurality of pressure chambers, each group of individual electrodes including a plurality of individual electrodes which are arranged in one row in one to one correspondence with the plurality of pressure chambers; and two detecting portions, formed on at least one of the plurality of piezoelectric sheets at two positions that are located on both ends of the row of the individual electrodes and that are shifted from the common electrodes, for being used to detect the position of the individual electrodes by being irradiated with light along the stacked direction, the piezoelectric actuator and the cavity unit being positioned relative to each other with an average position of the two detecting portions being substantially coincident with an average position of the two cavity-unit detecting portions, thereby allowing each individual electrode being located substantially at a position corresponding to one pressure chamber.

According to another aspect, the present invention provides a method of producing an inkjet print head, the method comprising the steps of: preparing a cavity unit, which is provided with a plurality of pressure chambers and which is formed with at least one cavity-unit detecting portion; preparing a plurality of green sheets, for a plurality of piezoelectric sheets, from piezoelectric material that transmits light therethrough upon irradiation with the light; printing a plurality of individual electrodes and at least one detecting portion on each of several ones of the plurality of piezoelectric green sheets and printing a common electrode on each of the other remaining piezoelectric green sheets at a position that is shifted from the position where the at least one detecting portion is printed on the several piezoelectric green sheets, the at least one detecting portion and the individual electrodes being made of the same material that blocks light when irradiated with light; stacking the plurality of piezoelectric green sheets one on another; sintering the stacked piezoelectric green sheets to form a piezoelectric actuator; radiating light onto the piezoelectric actuator in the stacked direction, thereby causing each detecting portion to form a shadow, picking up at least one image of the at least one shadow, to obtain information on the position of the at least one detecting portion; picking up an image of the at least one cavity-unit detecting portion on the cavity unit, to obtain information on the position of the at least one cavity-unit detecting portion; positioning the piezoelectric actuator and the cavity unit relative to each other based on the information on the position of the at least one detecting portion and on the position of the at least one cavity-unit detecting portion, thereby allowing each individual electrode to be positioned in correspondence with a corresponding pressure chamber; and bonding the piezoelectric actuator and the cavity unit relative to each other.

BRIEF DESCRIPTION OF THE DRAWINGS

The above and other objects, features and advantages of the invention will become more apparent from reading the following description of the preferred embodiments taken in connection with the accompanying drawings in which.

DETAILED DESCRIPTION OF THE PREFERRED EMBODIMENT

Figure 1:
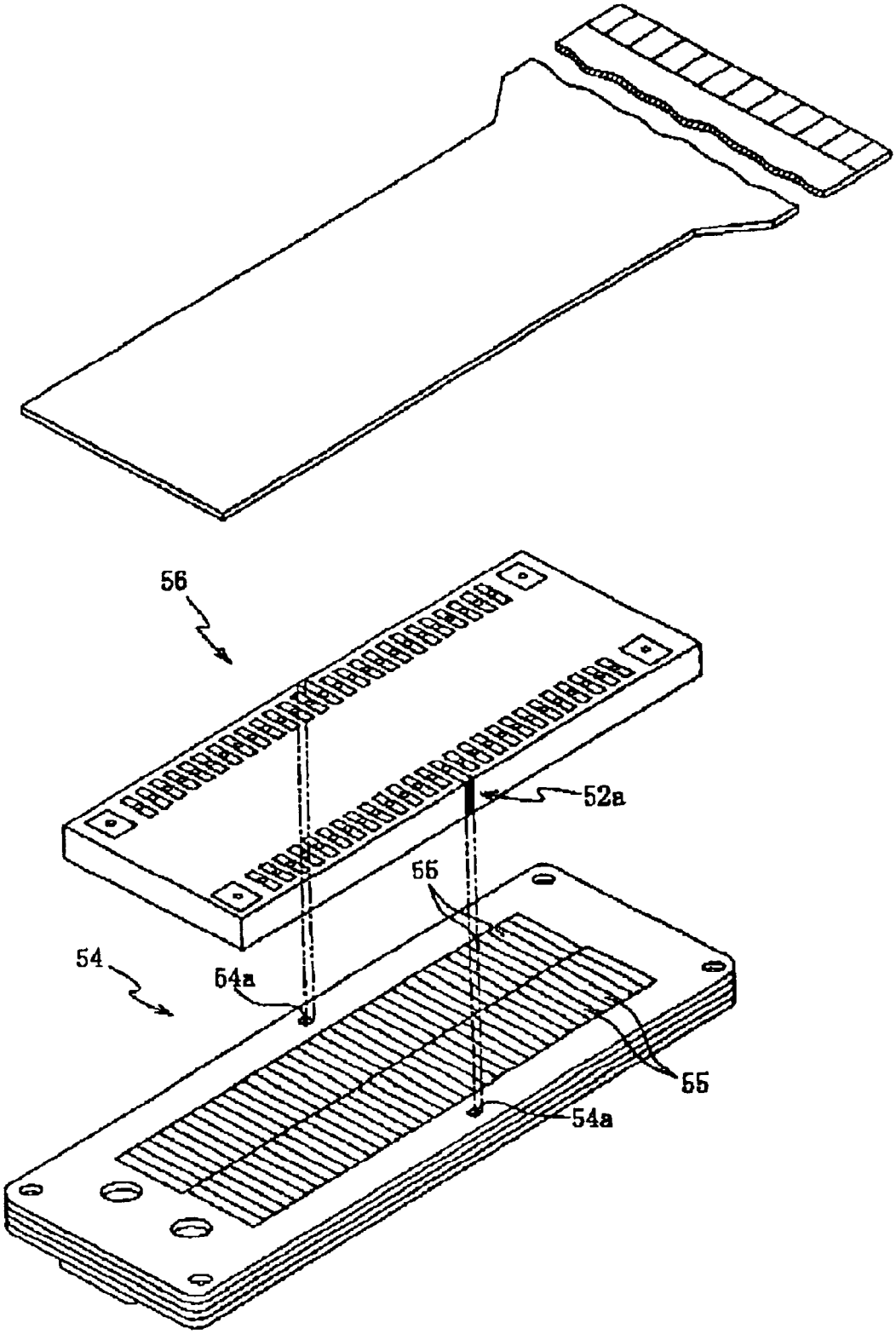
FIG. 1 is a perspective view showing the components of a conceivable inkjet print head.
Figure 2:
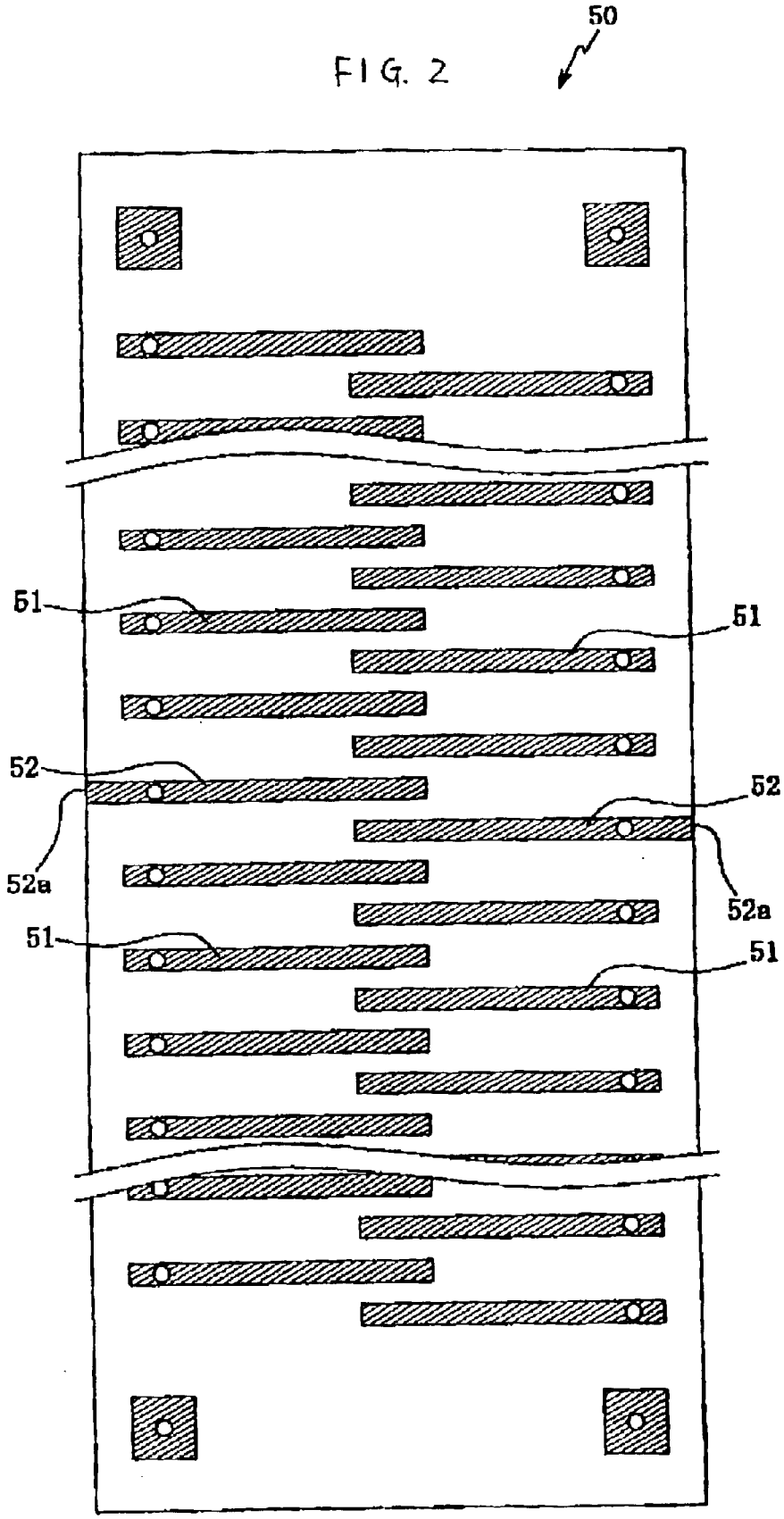
FIG. 2 is a plan view showing a pattern of individual electrodes provided on a piezoelectric sheet in the conceivable inkjet print head of FIG. 1.

An inkjet print head according to a preferred embodiment of the present invention will be described while referring to the accompanying drawings wherein like parts and components are designated by the same reference numerals to avoid duplicating description.

An inkjet print head according to preferred embodiments of the present invention will be described while referring to FIGS. 3 through 12.

Figure 3:
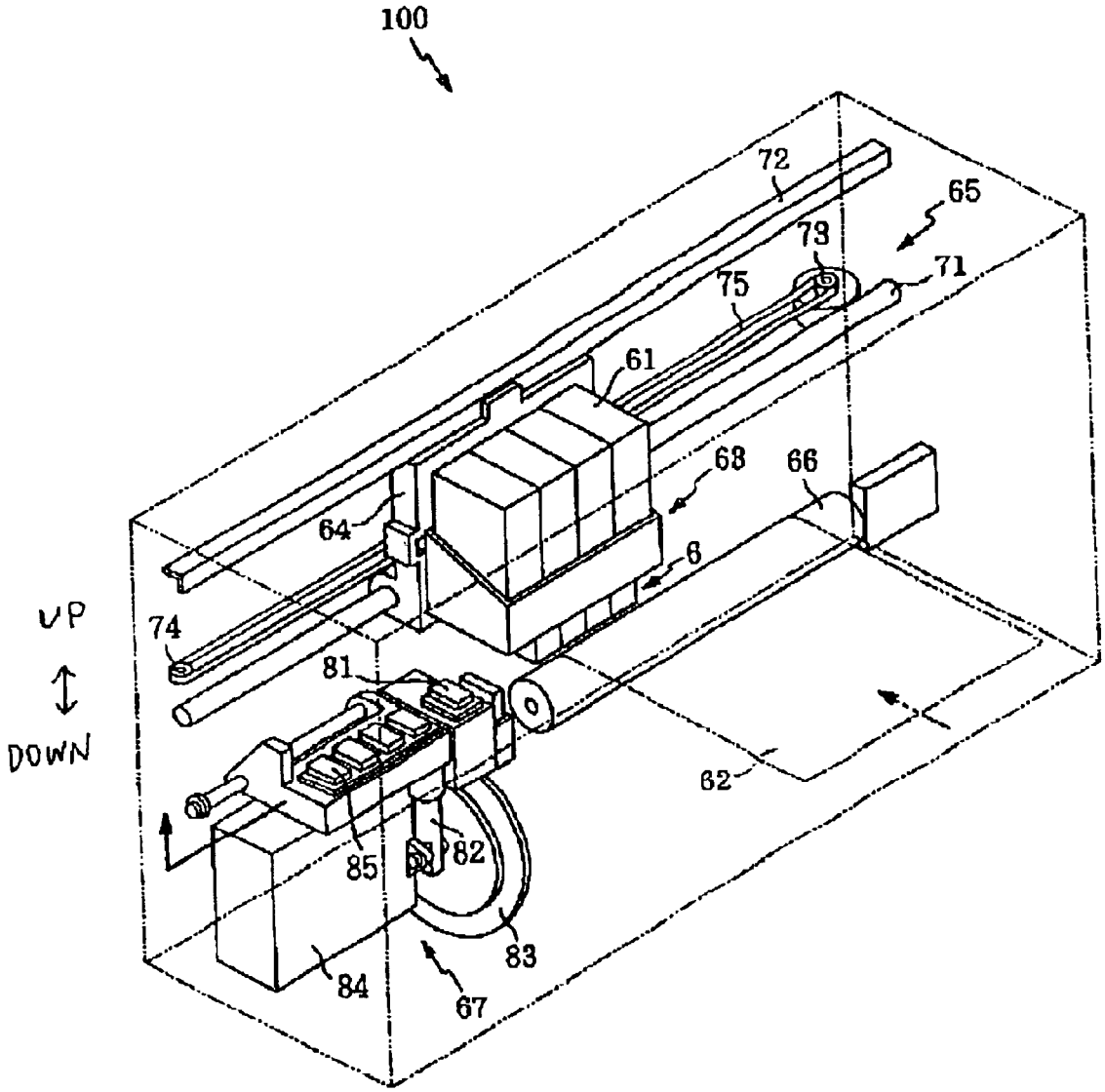
FIG. 3 is a perspective view showing a color inkjet printer which employs an inkjet print head according to an embodiment of the present invention.

FIG. 3 is a perspective view showing a color inkjet printer 100 employing an inkjet print head 6 according to the present embodiment of the present invention. As shown in FIG. 3, the color inkjet printer 100 includes: four ink cartridges 61; a head unit 63; a carriage 64; a drive unit 65; a platen roller 66; and a purging system 67. Each of the four ink cartridges 61 is filled with a color ink such as cyan, magenta, yellow and black. The head unit 63 is provided with four inkjet print heads 6. Each inkjet print head 6 is for printing on a paper 62. The ink cartridges 61 and the head unit 63 are mounted the carriage 64. The drive unit 65 is for reciprocally moving the carriage 64 in a linear direction. The platen roller 66 is disposed opposite the inkjet print heads 6 and extends along the reciprocal traveling direction of the carriage 64.

The drive unit 65 includes: a carriage shaft 71 provided on the bottom of the carriage 64 and extending parallel to the platen roller 66; a guide plate 72 provided on the top of the carriage 64 and extending parallel to the carriage shaft 71; two pulleys 73 and 74, provided between the carriage shaft 71 and guide plate 72, and on both ends of the carriage shaft 71; and an endless belt 75 looped around the pulleys 73 and 74.

The pulley 73 is driven to rotate in forward and reverse directions by a drive motor (not shown). When the pulley 73 rotates, the carriage 64 joined with the endless belt 75 is moved reciprocally in a linear direction along the carriage shaft 71 and guide plate 72.

The paper 62 is supplied from a paper feed cassette (not shown) disposed on one side of the color inkjet printer 100 and introduced between the inkjet print head 6 and platen roller 66. At this time, ink is ejected from the inkjet print head 6 to perform a prescribed printing on the paper 62, and subsequently the paper 62 is discharged. The mechanism for feeding the paper 62 and the mechanism for discharging the paper 62 have been omitted from FIG. 3.

The purging system 67 is provided to one side of the platen roller 66. The purging system 67 is positioned opposite the inkjet print head 6 when the head unit 63 is moved to a reset position. The purging system 67 includes: a purge cap 81 for covering a plurality of nozzles formed in one inkjet print head 6 by coming into contact with the openings in these nozzles; a pump 82; a cam 83; and an ink reservoir 84. When the head unit 63 is in the reset position, the purge cap 81 covers the nozzles in one inkjet print head 6. The cam 83 drives the pump 82 to draw defective ink containing residual air bubbles and the like from the inkjet print head 6 in order to restore the inkjet print head 6. The withdrawn defective ink is stored in the ink reservoir 84.

Four caps 85 are provided to cover a plurality of nozzles 15 (see FIG. 4) in the four inkjet print heads 6, respectively, after a printing operation is completed and the carriage 64 is returned to the reset position. It is possible to prevent the ink from drying out.

Figure 4:
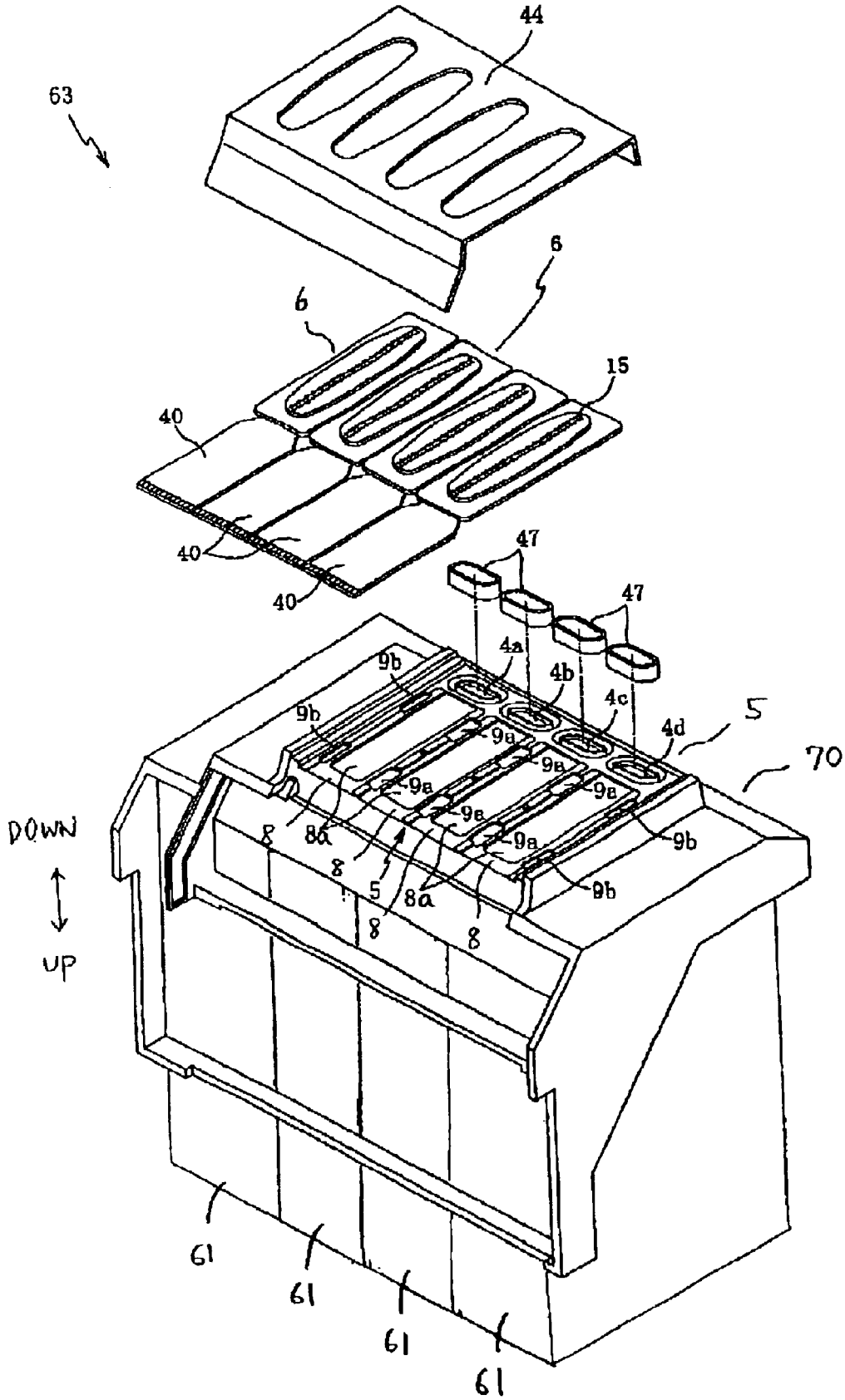
FIG. 4 is an exploded perspective view of a head unit, in the printer of FIG. 3, viewed with the nozzle side on top.

FIG. 4 is an exploded perspective view showing the head unit 63 with the nozzles 15 facing upward. As shown in FIG. 4, the head unit 63 has a substantial box shape with an open top surface. The head unit 63 has a mounting unit 70 capable of detachably mounting four ink cartridges 61 inserted through the top. The mounting unit 70 has a bottom plate 5. Four ink supply channels 4*a*, 4*b*, 4*c* and 4*d* penetrate the bottom plate 5 to be opened on the bottom surface thereof. The ink supply channels 4*a*, 4*b*, 4*c* and 4*d* connect with ink emitting parts of the ink cartridges 61, respectively. Packing 47, made of rubber material or the like, is provided on each of the ink supply channels 4*a*, 4*b*, 4*c* and 4*d* for forming a hermetic seal with ink supply holes 19*a* in a corresponding print head 6 (FIG. 6).

Four supporting units 8 are provided on the bottom surface of the bottom plate 5. The supporting units 8 are arranged in parallel with one another. Each supporting unit 8 has a central depression 8*a*. Each supporting unit 8 is for positioning a corresponding inkjet print head 6. A plurality of spaces 9*a* and 9*b* vertically penetrate the supporting units 8. The four inkjet print heads 6 are mounted on the four supporting units 8, respectively, and are fixed with a UV adhesive provided in the spaces 9*a* and 9*b*. A head cover 44 is provided over the inkjet print heads 6.

Figure 5:
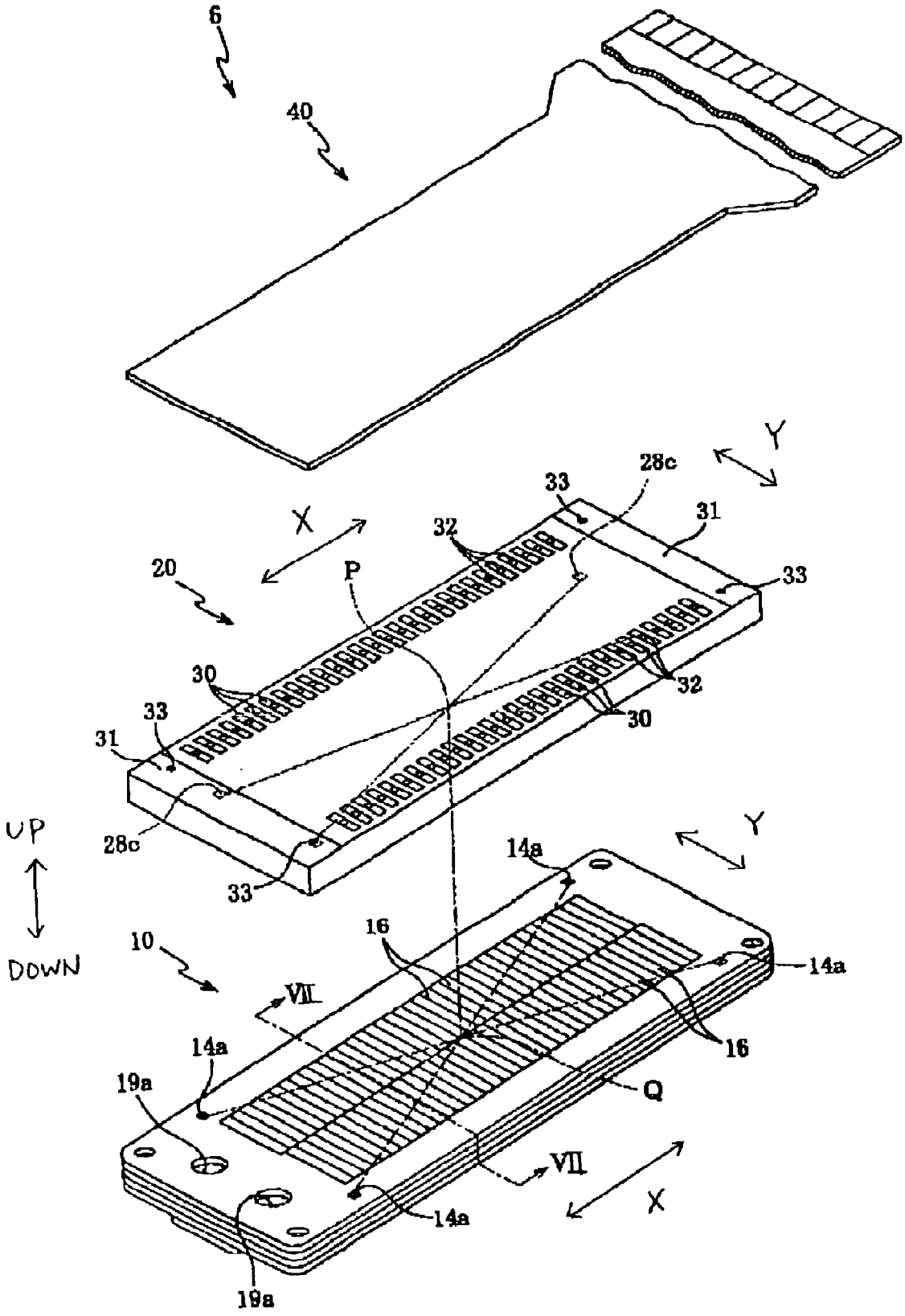
FIG. 5 is an exploded perspective view showing the components in an inkjet print head provided in the head unit of FIG. 4.

FIG. 5 is a perspective view showing the inkjet print head 6. As shown in FIG. 5, the inkjet print head 6 includes: a stacked-type cavity unit 10, a plate-shaped piezoelectric actuator 20, and a flexible flat cable 40. The plate-shaped piezoelectric actuator 20 is stacked on and adhered to the cavity unit 10 via an adhesive sheet or adhesive material (not shown). The flexible flat cable 40 is overlaid on the top surface of the piezoelectric actuator 20. The flexible flat cable 40 is for providing an electrical connection to external equipment. Ink is ejected downward through nozzles 15 (FIG. 6), which are formed as openings in the bottom surface of the cavity unit 10.

Figure 6:
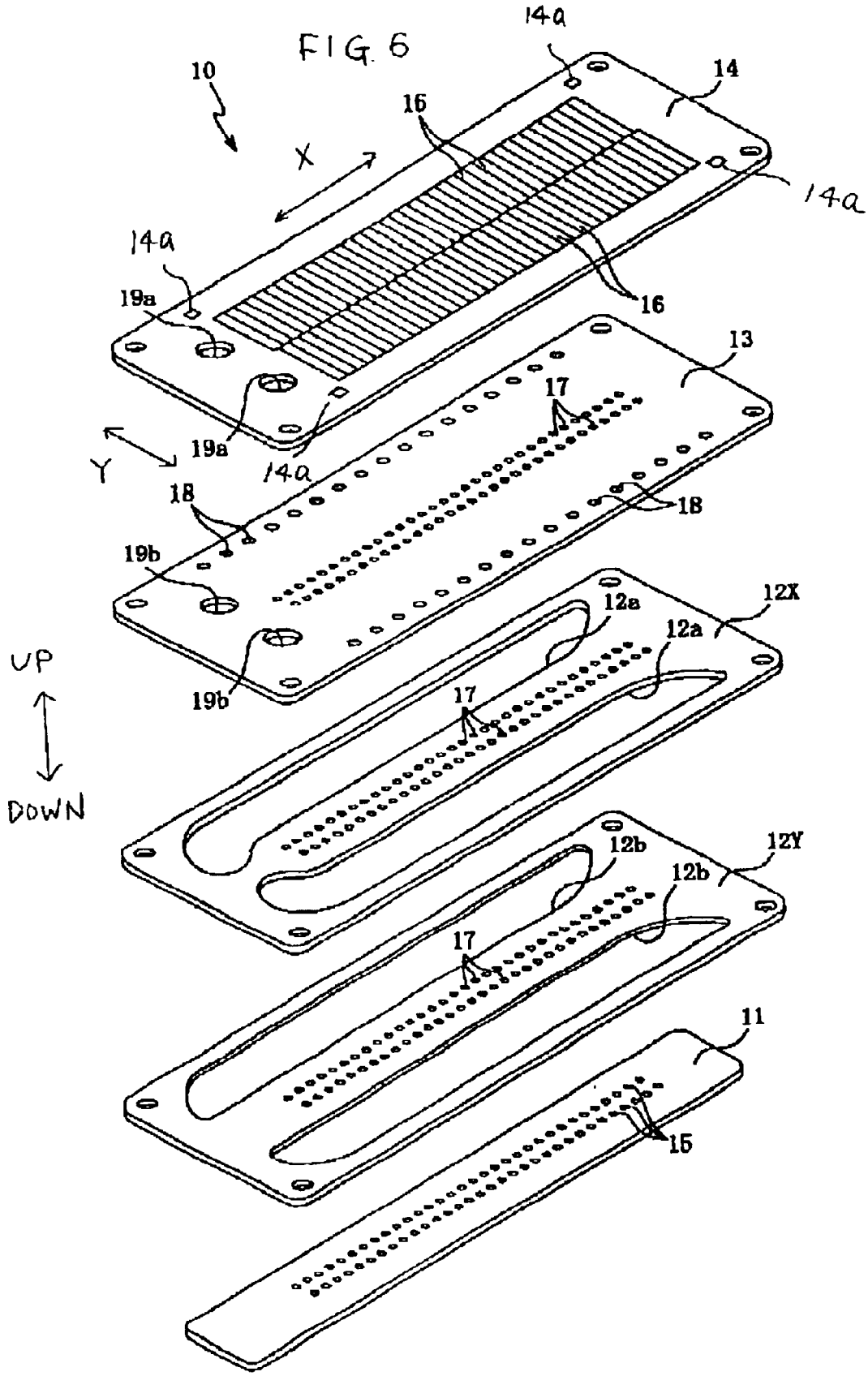
FIG. 6 is an exploded perspective view of a cavity unit in the inkjet print head of FIG. 5.
Figure 7:
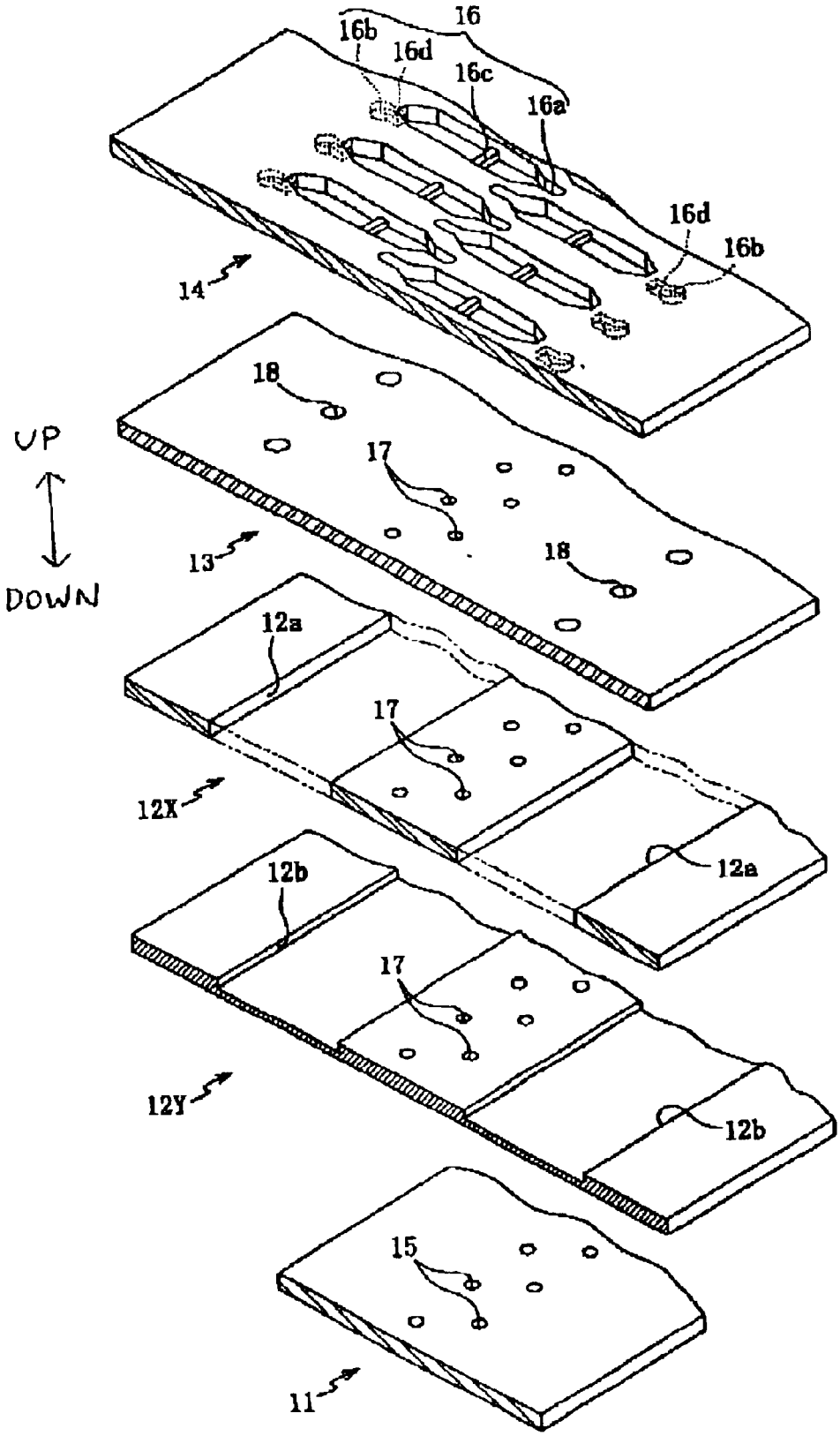
FIG. 7 is an enlarged exploded perspective view of the cavity unit along the line VII indicated in FIG. 5.

FIG. 6 is an exploded perspective view showing the cavity unit 10. FIG. 7 is an exploded, enlarged perspective view of the cavity unit 10 along the direction indicated by the arrows VII in FIG. 5.

As shown in FIG. 6, the cavity unit 10 is configured from: a nozzle plate 11, two manifold plates 12X and 12Y, a spacer plate 13, and a base plate 14 that are stacked together. These five plates are thin metal plates bonded together by an adhesive. In the present embodiment, each of the plates 11–14 is formed of steel plates with 42% nickel alloy (42% alloy) at a thickness of approximately 50–150 $\mu$m. However, the plates 11–14 are not limited to a metal material, but can also be formed of a resin or the like.

The base plate 14 is of a rectangular shape with four corners. That is, the base plate 14 is elongated in a lengthwise direction (first direction) X. The base plate 14 has a pair of long sides and a pair of short sides. The long sides are elongated in the lengthwise direction x. The short sides are along a widthwise direction (second direction) Y orthogonal to the lengthwise direction X. The long sides are longer than the short sides. The base plate 14 is formed with four positioning marks 14*a* at its for corners.

As shown in FIG. 7, a plurality of pressure chambers 16 are formed in the base plate 14. The pressure chambers 16 are arranged in rows that extend along the lengthwise direction (first direction) X of the base plate 14, and are interleaved with one another in a staggered pattern. The pressure chambers 16 are formed as narrow slots penetrating the base plate 14. Each pressure chamber 16 extends in the widthwise direction (second direction) Y orthogonal to the lengthwise direction X of the base plate 14. Each pressure chamber 16 has a restricting portion 16*c* for restricting a speed of ink flow in the pressure chamber 16. A plurality of narrowing parts 16*d* are provided on the base plate 14 as being connected with the pressure chambers 16. A plurality of ink supply holes 16*b* are provided on the base plate 14 as being connected with the narrowing parts 16*d*. The narrowing parts 16*d* and the ink supply holes 16*b* are formed as depressions in the spacer plate 13 side of the base plate 14. A plurality of ink supply holes 18 are formed through both the left- and right-sides of the spacer plate 13. The ink supply holes 16*b* are in fluid communication with common ink chambers 12*a*, formed in the manifold plate 12X, via the ink supply holes 18. The cross-sectional area in each narrowing part 16*d* orthogonal to the direction in which ink flows is smaller than the cross-sectional area in each pressure chamber 16. The cross-sectional area of the narrowing part 16*d* is made smaller to increase flow resistance.

A plurality of nozzles 15 penetrate the nozzle plate 11. The nozzles 15 are arranged in a staggered manner. One end 16*a* of each pressure chamber 16 is in fluid communication with one nozzle 15 via through-holes 17 of micro-sized diameters. The through-holes 17 penetrate the spacer plate 13 and both the manifold plates 12X and 12Y, and are interleaved in the same way as the nozzles 15.

As shown in FIG. 6, two ink supply holes 19*a* and two ink supply holes 19*b* are formed through the base plate 14 and spacer plate 13, respectively, for supplying ink from a corresponding ink cartridge to the two common ink chambers 12*a*.

In order to form a compact ink jet head, the ink supply holes 19*a* are formed in the base plate 14 near the ends of the rows of the plurality of pressure chambers 16. Since ink is supplied to the two ink supply holes 19*a* from the single ink cartridge, the two ink supply holes 19*a* are disposed in close proximity to each other. The two ink supply holes 19*a* supply ink to the two corresponding ink chambers 12*a* via the two ink supply holes 19*b*. It is noted that only one ink supply hole 19*a* may be formed in the base plate 14, provided that two ink supply holes 19*b* are formed in the spacer plate 13.

As shown in FIG. 6, the two common ink chambers 12*a* formed in the manifold plate 12X are provided on either side of the row of nozzles 15 formed in the nozzle plate 11. Similarly, the two common ink chambers 12*b* formed in the manifold plate 12Y are provided on either side of the row of nozzles 15 formed in the nozzle plate 11. These common ink chambers 12*a* and common ink chambers 12*b* are positioned within planes which are parallel to the plane, in which the plurality of pressure chambers 16 are formed, and are disposed closer to the openings of the nozzles 15 formed in the nozzle plate 11 than to the pressure chambers 16.

The common ink chambers 12*a* penetrate the manifold plate 12X, which is located on the spacer plate 13 side of the two manifold plates. The common ink chambers 12*b* are formed as depressions in the manifold plate 12Y, which is located in the nozzle plate 11 side of the two manifold plates, to be opened only toward the manifold plate 12X side. By stacking the two manifold plates 12X and 12Y and the spacer plate 13 together, the common ink chambers 12*a* and common ink chambers 12*b* are connected to form one common ink channel on either side of the row of through-holes 17. This configuration ensures that a sufficient amount of ink is supplied to the pressure chambers 16. The two rows of common ink chambers are provided one on either side of the through-holes 17 and correspond to the two rows of pressure chambers 16.

As shown in FIG. 6, the nozzles 15 are formed in the nozzle plate 11 for ejecting ink. The nozzles 15 penetrate the nozzle plate 11 and are interleaved along the lengthwise direction of the nozzle plate 11 separated by a micropitch P. The diameter of the nozzles 15 is very small. In the present embodiment, the diameter of the nozzles 15 is approximately 25 $\mu$m.

With the cavity unit 10 having the configuration described above, ink is introduced into the common ink chambers 12*a* and 12*b* via the ink supply holes 19*a* and 19*b*. The ink introduced into the common ink chambers 12*a* and 12*b* is distributed to each of the pressure chambers 16 via the ink supply holes 18, the ink supply holes 16*b*, and the narrowing parts 16*d*. Ink introduced into the pressure chambers 16 flows toward the end 16*a*, passes through the through-holes 17, and reaches the nozzles 15 corresponding to the pressure chambers 16.

Next, the piezoelectric actuator 20 will be described with reference to FIGS. 8–11.

Figure 8:
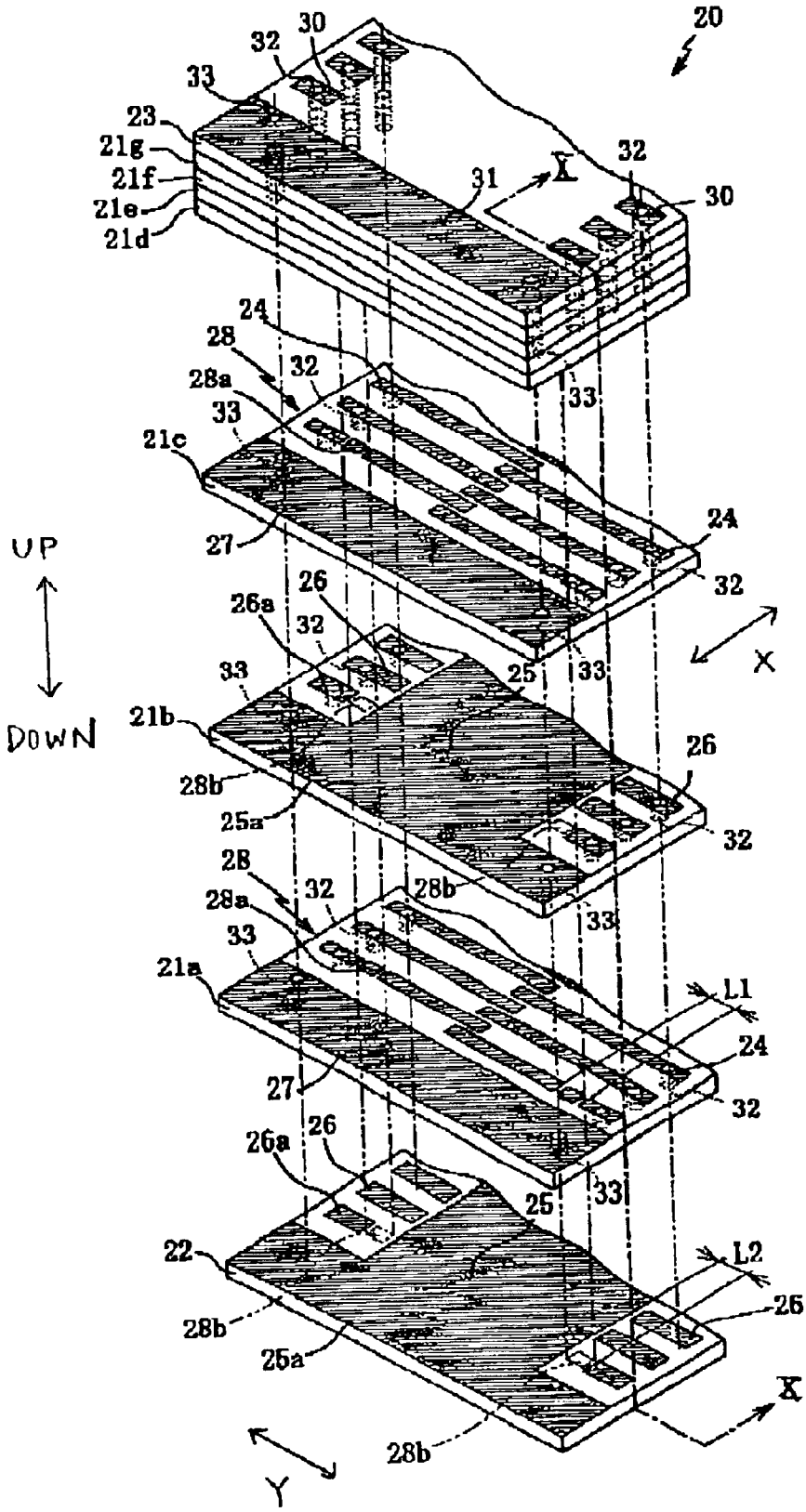
FIG. 8 is an enlarged exploded perspective view showing a piezoelectric actuator in the inkjet print head of FIG. 5.
Figure 10:
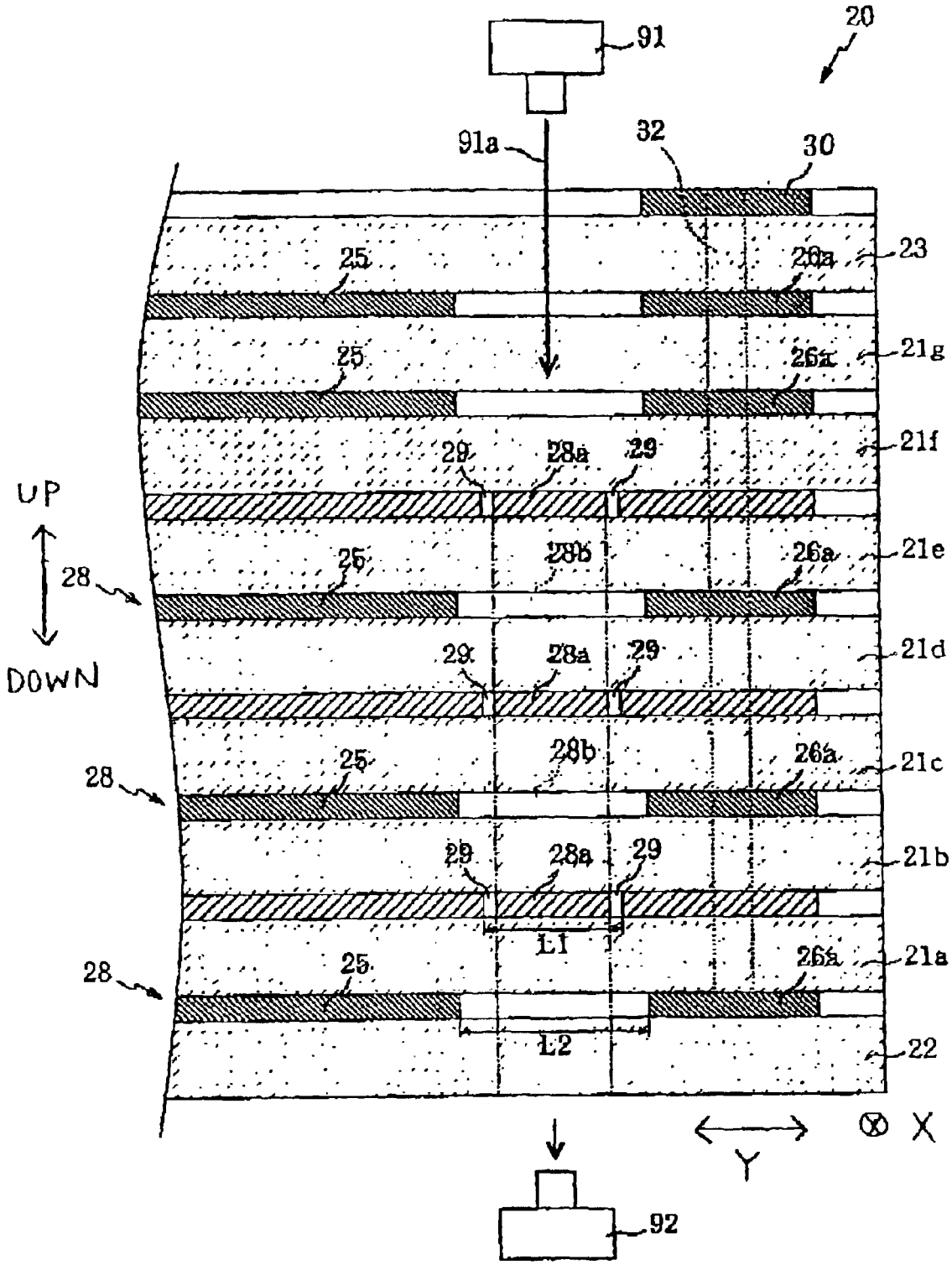
FIG. 10 is a cross-sectional view of the piezoelectric actuator along the line X indicated in FIG. 8.

As shown in FIGS. 8 and 10, the piezoelectric actuator 20 is configured from nine piezoelectric ceramic sheets (which will be abbreviated as "piezoelectric sheets" hereinafter) 21*a*, 21*b*, 21*c*, 21*d*, 21*e*, 21*f*, 21*g*, 22 and 23, which are stacked one on another. Each piezoelectric sheet is of a rectangular shape with four corners. That is, each piezoelectric sheet is elongated in a lengthwise direction (first direction) X. Each piezoelectric sheet has a pair of long sides and a pair of short sides. The long sides are elongated in the lengthwise direction X. The short sides are along a widthwise direction (second direction) Y orthogonal to the lengthwise direction X. The long sides are longer than the short sides. Each piezoelectric sheet is large enough to span all of the pressure chambers 16. Each piezoelectric sheet is made of piezoelectric ceramic material that can transmit light therethrough when irradiated with the light.

It is noted that the upper and lower sheets 23 and 22 can be formed of an insulating material rather than a piezoelectric ceramic material, provided that the insulating material can transmit light therethrough when irradiated with the light.

Figure 9:
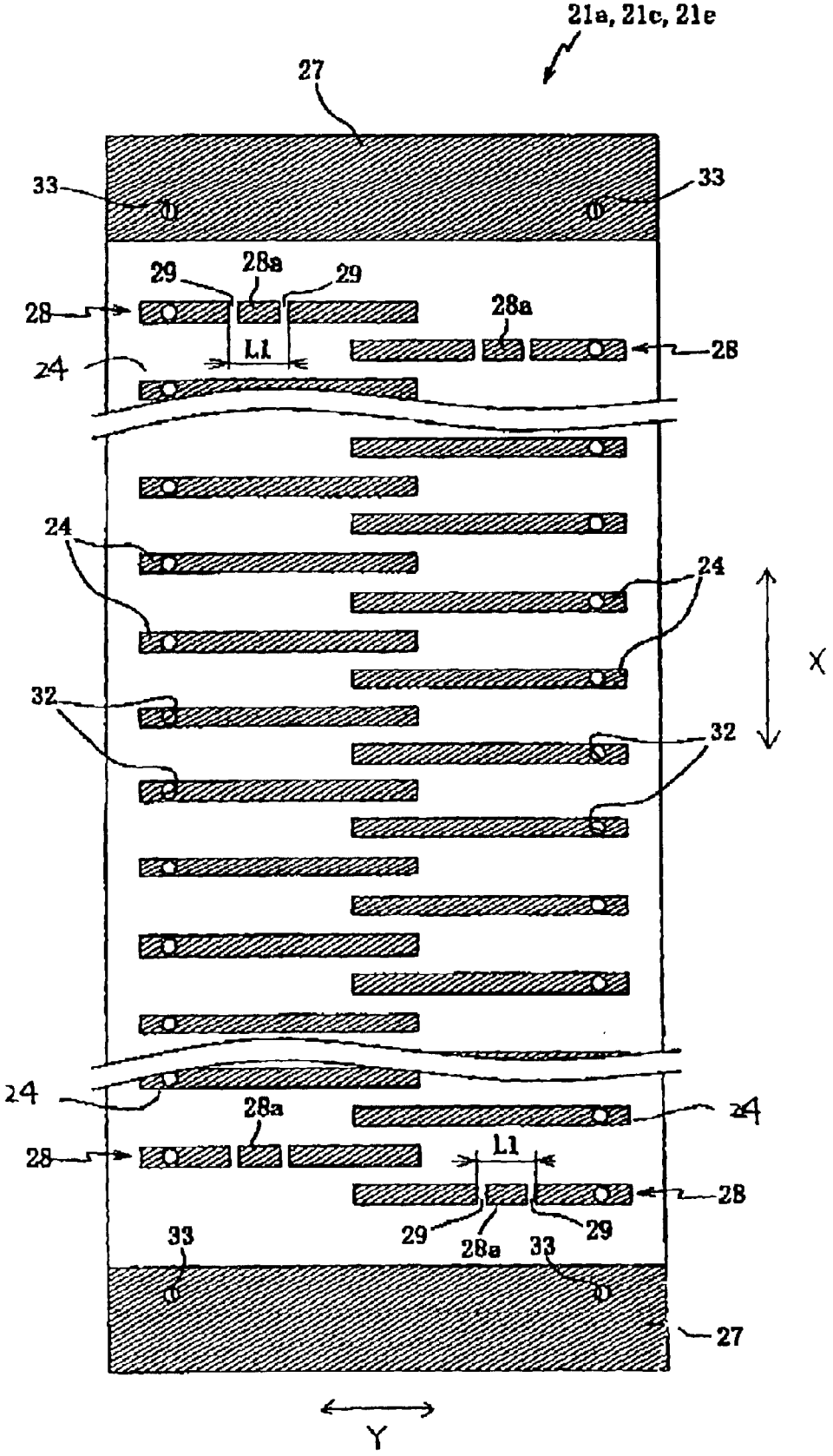
FIG. 9 is a plan view showing a pattern of the individual electrodes provided on a piezoelectric sheet.

As shown in FIGS. 8 and 9, a plurality of individual electrodes 24, two dummy common electrodes 27, and four dummy electrodes 28 are formed on the top surface of each of the piezoelectric sheets 21*a*, 21*c*, and 21*e*. The individual electrodes 24 are formed in narrow strips, each corresponding to one pressure chamber 16 in the cavity unit 10. The individual electrodes 24 are arranged in two rows along the lengthwise direction (first direction) X of the piezoelectric sheet. Each individual electrode 24 has a rectangular shape that is elongated in the widthwise direction (second direction) Y of the piezoelectric sheet orthogonal to the lengthwise direction X. In the present embodiment, the width of each individual electrode 24 is set slightly narrower than the width of the corresponding pressure chamber 16. The dummy common electrodes 27 are formed in substantially rectangular shapes, and are provided for covering the ends of the piezoelectric sheets 21*a*, 21*c*, and 21*e*.

The dummy electrodes 28 are formed of the same material as the individual electrodes 24. The dummy electrodes 28 are provided on both ends of the rows of individual electrodes 24. In this way, four dummy electrodes 28, in total, are provided on each of the piezoelectric sheets 21*a*, 21*c*, and 21*e*.

Each dummy electrode 28 is elongated along the widthwise direction (second direction) Y of the piezoelectric sheet. Each dummy electrode 28 is formed as a narrow strip similar to the individual electrodes 24. However, as shown in FIG. 9, gaps 29 are formed at two locations in the middle of the dummy electrode 28. Each gap 29 extends parallel to the lengthwise direction (first direction) X of the piezoelectric sheet, thereby dividing the dummy electrode 28 into three parts. The part of the dummy electrode 28 interposed between the two gaps 29 functions as a positioning mark 28*a*. The positioning mark 28*a* has a substantially rectangular shape. The entire length, that covers the positioning mark 28*a* and the two gaps 29 that sandwich the positioning mark 28*a* therebetween, has a value L1. The positioning mark 28*a* is surrounded by the two gaps 29, a neighboring individual electrode 24, and the dummy common electrode 27. In this way, four positioning marks 28*a* are provided at four corners of each of the piezoelectric sheets 21*a*, 21*c*, and 21*e*.

As shown in FIG. 8, a common electrode 25, a plurality of first dummy individual electrodes 26, and four second dummy individual electrodes 26*a* are formed on the top surface of each of the piezoelectric sheets 22, 21*b*, 21*d*, 21*f*, and 21*g*. It is noted that only two of the four second dummy individual electrodes 26*a* are shown in FIG. 8. The common electrode 25 is provided in correspondence with all the pressure chambers 16. It is noted that as shown in FIG. 6, the pressure chambers 16 are arranged in two rows along the lengthwise direction (first direction) X of the base plate 14 and are positioned in the central area in the base plate 14 in the widthwise direction (second direction) Y of the base plate 14. Accordingly, the common electrode 25 is located in the central portion of each of the piezoelectric sheets 22, 21*b*, 21*d*, 21*f*, and 21*g* in the widthwise direction (second direction) Y and is formed in a substantially rectangular shape that extends along the lengthwise direction (first direction) X in order to cover all of the two rows of pressure chambers 16. Each common electrode 25 is integrally formed with a pair of extended parts 25*a* at both of the pair of lengthwise ends of the piezoelectric sheet. Only one of the pair of extended parts 25*a* is shown in FIG. 8. Each extended part 25*a* extends along approximately the entire width of the corresponding piezoelectric sheet.

The first dummy individual electrodes 26 are formed with a width equivalent to that of the individual electrodes 24, but are shorter in length than the individual electrodes 24. The first dummy individual electrodes 26 are disposed at the positions corresponding to the individual electrodes 24 along the stacked direction. In other words, the first dummy individual electrodes 26 are disposed at the same horizontal positions with the individual electrodes 24. Each first dummy individual electrode 26 has a pair of opposite ends, one being near to the side edge of the piezoelectric sheet and the other being near to the side edge of the common electrode 25. The one end of the first dummy individual electrode 26 that is near to the side edge of the piezoelectric sheet is located at a position that approximately corresponds to the end of the corresponding individual electrode 24 near to the side edge of the piezoelectric sheet. The other end of the first dummy individual electrode 26 is located so that a gap of a prescribed interval is formed between the other end of the first dummy individual electrode 26 and the side edge of the common electrode 25.

The four second dummy individual electrodes 26*a* are disposed at the positions corresponding to the four dummy electrodes 28 along the stacked direction. In other words, the second dummy individual electrodes 26*a* are disposed at the same horizontal positions with the dummy electrodes 28. Each second dummy individual electrode 26*a* has a width substantially equal to that of the dummy electrodes 28, but has a shorter length than the dummy electrodes 28. The second dummy individual electrode 26*a* is also shorter than the first dummy individual electrode 26. A gap 28*b* is therefore formed between the inner-side end of the second dummy individual electrode 26*a* and the side edge of the common electrode 25. The length L2 of the gap 28*b* is longer than the length L1, which is defined as a distance between the outer side edges of the two gaps 29, in which the positioning mark 28*a* is interposed (see FIG. 10). It is noted that the lengths L1 and L2 may be set to substantially equal to each other.

In this way, the gap 28*b* is formed to have an area substantially greater than or equal to the total area of the positioning mark 28*a* and the two second gaps 29 that sandwich the positioning mark 28*a* therebetween. Accordingly, as will be described later with reference to FIG. 10, when a light beam 91*a* is irradiated on the entire region of the positioning mark 28*a* and the two second gaps 29 along the stacked direction, the light beam 91*a* will pass through the gap 28*b* to form a complete shadow 28*c* of the positioning mark 28*a*.

A plurality of surface electrodes 30 are formed on the top surface of the top sheet 23 in correspondence with the plurality of individual electrodes 24 and the dummy electrodes 28. The plurality of surface electrodes 30 are arranged in the lengthwise direction (first direction) X along the pair of long sides of the top sheet 23. Two additional surface electrodes 31 are also provided on the top surface of the top sheet 23. Only one of the two additional surface electrodes 31 is shown in FIG. 8. Each additional surface electrode 31 is located at a position that corresponds to one extended part 25*a* of the common electrodes 25.

Through-holes 32 are formed through the piezoelectric sheets 21*a*, 21*b*, 21*c*, 21*d*, 21*e*, 21*f*, 21*g*, and top sheet 23 such that the surface electrodes 30, individual electrodes 24, and the first dummy individual electrodes 26 at corresponding positions are in fluid communication with one another and such that the surface electrodes 30, dummy electrodes 28, and the second dummy individual electrodes 26*a* at corresponding positions are in fluid communication with one another.

Similarly, through-holes 33 are formed through the piezoelectric sheets 21*a*, 21*b*, 21*c*, 21*d*, 21*e*, 21*f*, 21*g*, and top sheet 23 such that the surface electrodes 31, the extended parts 25*a*, and the dummy common electrodes 27 at corresponding positions are in fluid communication with one another.

The through-holes 32 are filled with a conductive material in order that each individual electrode 24 and the surface electrode 30 in the corresponding position along a line in the stacking direction are electrically connected and in order that each dummy electrode 28 and the surface electrode 30 in the corresponding position along a line in the stacking direction are electrically connected. Similarly, the through-holes 33 are filled with a conductive material in order that each common electrode 25 and the surface electrode 31 in the corresponding position along a line in the stacking direction are electrically connected.

With this construction, the individual electrodes 24 and the first dummy individual electrodes 26 at the corresponding positions along the stacking direction of the plurality of piezoelectric sheets 21, 22, 23 are electrically connected to the corresponding surface electrodes 30. The dummy electrodes 28 and the second dummy individual electrodes 26*a* at the corresponding positions along the stacking direction of the plurality of piezoelectric sheets 21, 22, 23 are electrically connected to the corresponding surface electrodes 30. Similarly, the common electrodes 25 and the dummy common electrodes 27 at the corresponding positions along the stacking direction are electrically connected to the corresponding surface electrodes 31.

It is noted that the individual electrodes 24, common electrodes 25, first and second dummy individual electrodes 26, 26*a*, dummy common electrodes 27, dummy electrodes 28, positioning marks 28*a*, surface electrodes 30, and surface electrodes 31 are formed by a screen printing process prior to sintering the green sheets of piezoelectric material. After forming the electrodes, the plurality of green sheets are stacked and positioned such that the electrodes are aligned in the stacked direction. After degreasing, the green sheets are formed integrally by sintering. It is noted that the surface electrodes 30 and surface electrodes 31 can be formed on the top surface of the piezoelectric actuator 20 after sintering.

After the sintering process, an adhesive sheet (not shown) is provided to the entire bottom surface of the piezoelectric actuator 20 (bottom surface of the piezoelectric sheet 22 that will oppose the pressure chambers 16 on the cavity unit 10 as shown in FIGS. 5 and 8) as an adhesive layer. The adhesive sheet is formed of a synthetic resin material impermeable to ink. The piezoelectric actuator 20 will be fixed to the cavity unit 10, via the adhesive sheet, in order that each individual electrode 24 an the piezoelectric actuator 20 will be aligned with a corresponding pressure chamber 16 in the cavity unit 10.

It is noted, however, that due to shrinkage of the piezoelectric sheets during the sintering process, the pitch between the individual electrodes 24 formed on the piezoelectric sheets grows smaller. As a result, it is difficult to determine from an external view the position of individual electrodes inside the stacked piezoelectric sheets. It is difficult to precisely position the piezoelectric actuator 20 relative to the cavity unit 10 so that each individual electrode 24 will coincide with a corresponding pressure chamber 16.

Considering this problem, according to the present embodiment, after the sintering process is completed and the adhesive sheet is attached on the bottom surface of the piezoelectric actuator 20, as shown in FIG. 10, a light source 91 is located on the top sheet 23 side of the piezoelectric actuator 20. The light source 91 is driven to radiate a light beam 91*a* on the positioning marks 28*a* at each of the four corners (FIG. 9). As shown in FIG. 10, electrodes or other objects that block the progress of the beam 91*a* are not formed along the lines extended in the stacking direction from the positioning marks 28*a*. That is, the gaps 28*b*, defined between the inner-side ends of the second dummy individual electrodes 26*a* and the side edges of the common electrodes 25, are formed along the lines in the stacking direction from the positioning marks 28*a*. Accordingly, the beam 91*a* passes through the piezoelectric actuator 20 while passing through the peripheral edges (gaps 29) of the positioning marks 28*a*. Then, the beam 91*a* is received by a receiving device 92, which is disposed on the piezoelectric sheet 22 side of the piezoelectric actuator 20.

Figure 11:
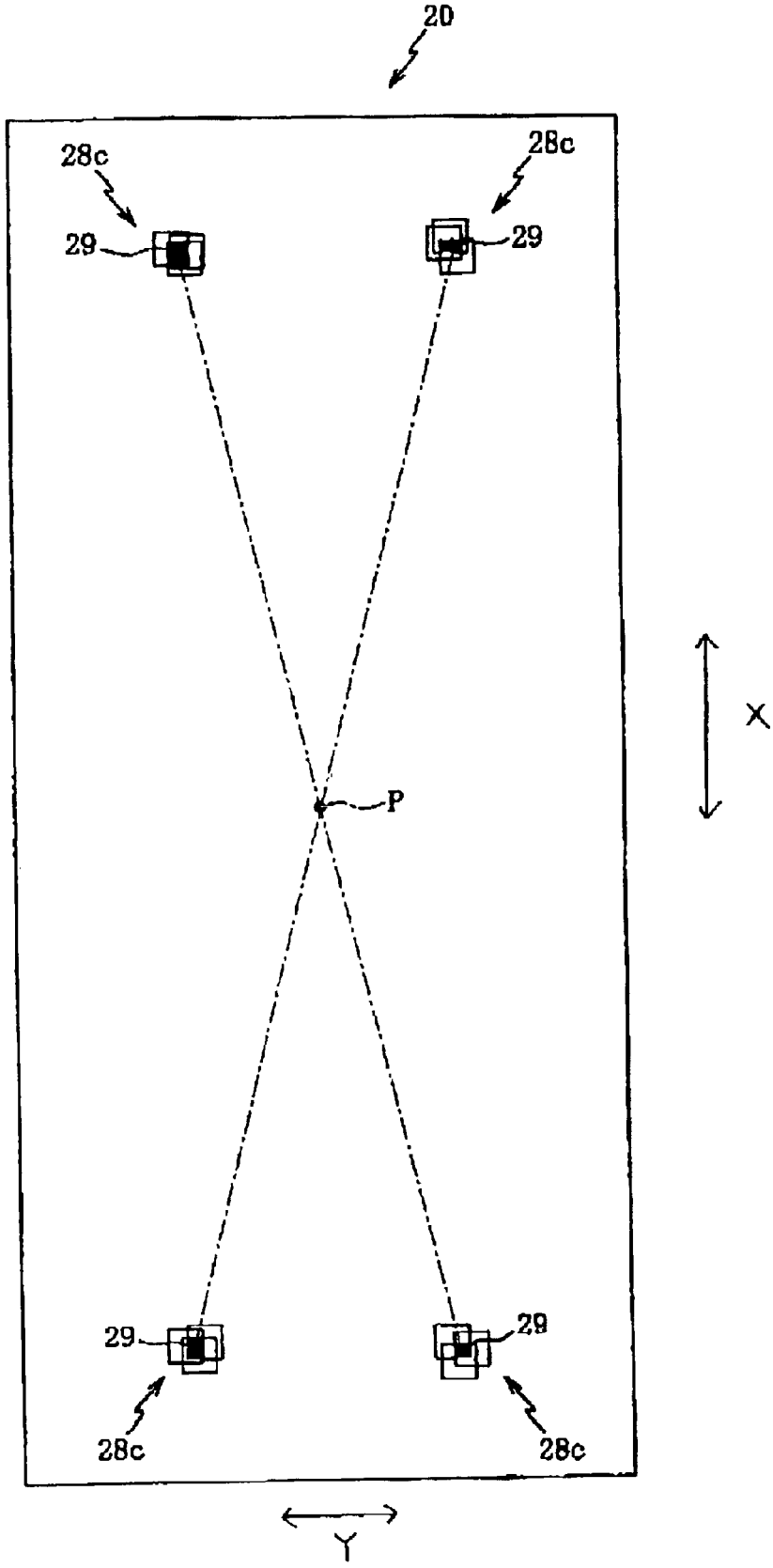
FIG. 11 is an explanatory diagram showing the shadows projected by positioning marks formed in the piezoelectric actuator.

It is noted that the positioning marks 28*a* are formed on the top surfaces of the three piezoelectric sheets 21*a*, 21*c*, and 21*e* at each of the four corners at the same horizontal position. That is, at each corner of the three piezoelectric sheets 21*a*, 21*c*, and 21*e*, the positioning marks 28*a* are disposed at positions in line with one another along the stacked direction. Accordingly, when the three dummy electrodes 28 are irradiated with the single light beam 91*a* from above and projected onto the piezoelectric sheets 22, 21*b*, and 21*d*, the light beam 91*a* bears thereon the shadows 28*c* of the three positioning marks 28*a*, and passes through the corresponding gaps 28*b*. Accordingly, the three positioning marks 28*a* at each corner cast three shadows 28*c* on the receiving device 92 as shown in FIG. 11.

An image processing device, such as a personal computer, (not shown) is used to detect the shape and position of the shadows 28*c*. More specifically, the image processing device detects the center of gravity in the densest or darkest part 29 of the overlapped region of the three shadows 28*c* that are formed in each corner. Then, two diagonal lines are drawn so that each diagonal line connects the centers of gravity in opposing two corners. The intersecting point P of the two diagonal lines is determined as the center of gravity for the piezoelectric actuator 20. It is noted that the positioning marks 28*a* are accurately affected from the positions of the individual electrodes 24 because the positioning marks 28*a* are formed of the same material as the individual electrodes 24. Thus, the shadows 28*c* can accurately indicate the positions of the individual electrodes 24.

As shown in FIG. 5, an imaging device (not shown) is used to pick up the images of the positioning marks 14*a*, which are formed in the four corners of the base plate 14. The images are then processed by the image processing device in the same manner as described above in order to determine a center of gravity Q of the four marks 14*a*. More specifcially, the image processing device first detects the center of gravity of an image of the mark 14*a* at each corner. Then, two diagonal lines are drawn so that each diagonal line connects the centers of gravity in opposing two corners. The intersecting point Q of the two diagonal lines is determined as the center of gravity for the cavity unit 10.

Then, a jig (not shown) retaining the piezoelectric actuator 20 and another jig (not shown) retaining the cavity unit 10 are moved relative to each other to align the centers of gravity P and Q. The relative angles of the two jigs are adjusted so that the lengthwise directions X of the piezoelectric actuator 20 and the cavity unit 10 are aligned with each other and so that the widthwise directions Y of the piezoelectric actuator 20 and the cavity unit 10 are aligned with each other. After correcting the relative angles of the two jigs, the piezoelectric actuator 20 and cavity unit 10 are adhesively fixed together via the adhesive sheet.

According to the present embodiment, the positioning marks 28*a* are formed in four locations, that is, on both ends of the two rows of individual electrodes. Because the two rows of individual electrodes are separated from each other in the widthwise direction of the piezoelectric sheet, the center of gravity for the four points can be accurately detected.

The shrinkage ratio is generally largest on both ends of the piezoelectric sheet. Because the positioning marks 28*a* are provided on both ends of each row of individual electrodes, it is possible to average the relative positional deviations between the respective individual electrodes 24. Accordingly, the pressure chambers 16 can be accurately positioned in correspondence with the individual electrodes 24 when the cavity unit 10 is bonded to the piezoelectric actuator 20.

Figure 12:
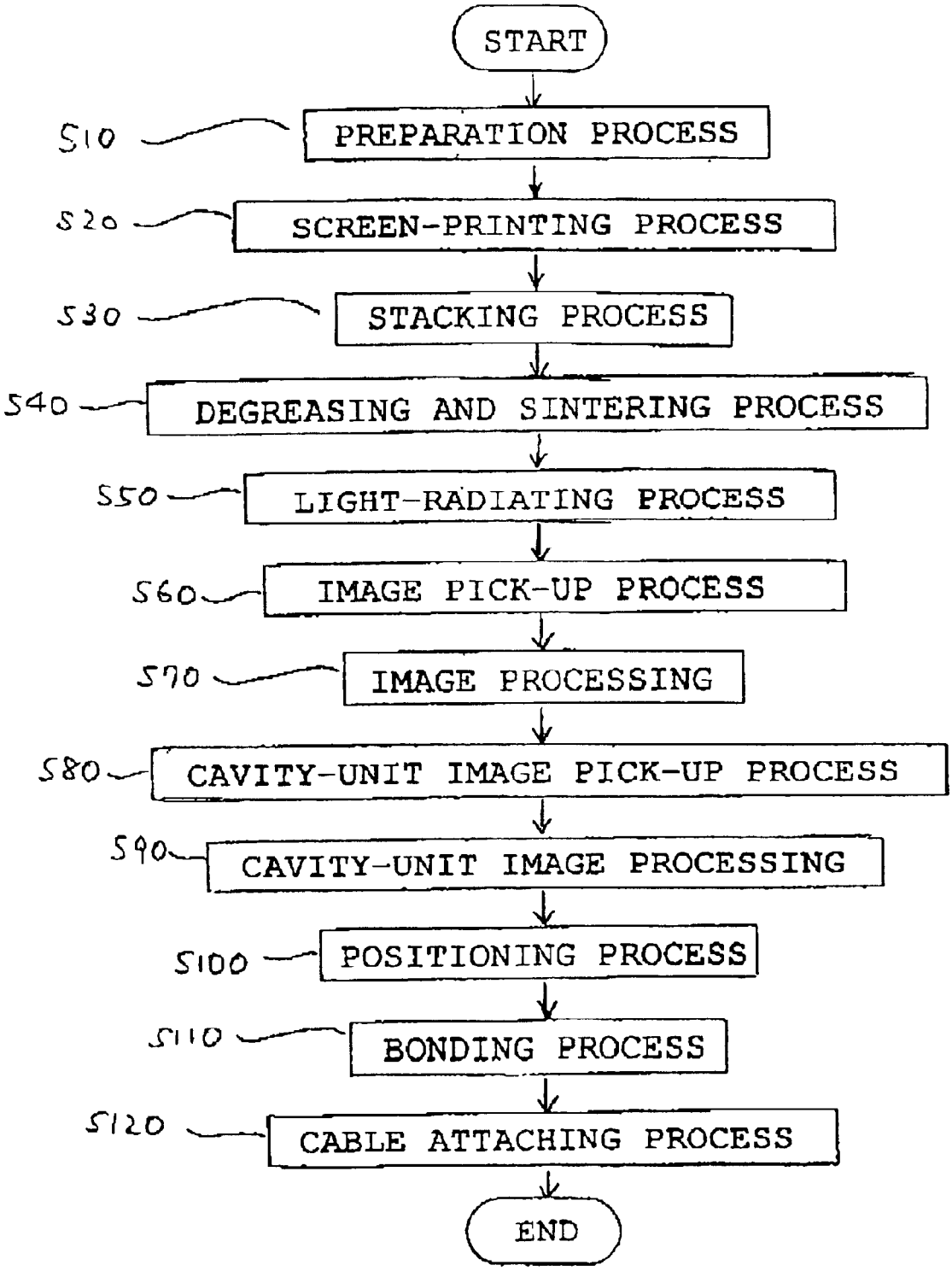
FIG. 12 is a flowchart showing the method how the inkjet print head of the present embodiment is produced.

According to the present embodiment, the inkjet print head 6 is produced in a manner described below with reference to FIG. 12.

First, in S10, a preparing process is executed to produce the cavity unit 10. The cavity unit 10 is provided with the plurality of pressure chambers 16 and is formed with the four positioning marks 14*a* as shown in FIG. 5. During the preparing process of S10, a plurality of green sheets for the plurality of piezoelectric sheets 21*a*–21*g*, 22, and 23 are prepared from piezoelectric material that transmits light therethrough upon irradiation with the light.

Next, in S20, a screen-printing process is executed to print the plurality of individual electrodes 24, the four dummy electrodes 28, and the two dummy common electrodes 27 simultaneously on each of piezoelectric green sheets for the piezoelectric sheets 21*a*, 21*c*, and 21*e*. Each dummy electrode 28 has three sections, which are separated from one another by the two gaps 29. The center one of the three sections will be used as a positioning mark 28*a*. It is noted that the dummy electrodes 28 and the individual electrodes 24 are made of the same material that blocks light when irradiated with light.

During the process of S20, the common electrode 25 and the first and second dummy individual electrodes 26 and 26*a* are printed on each of piezoelectric green sheets for the piezoelectric sheets 22, 21*b*, 21*d*, 21*f*, and 21*g*. As shown in FIG. 10, the common electrode 25 and the first and second dummy individual electrodes 26 and 26*a* are arranged on the piezoelectric green sheets 22, 21*b*, 21*d*, 21*f*, and 21*g* so that the gaps 28*b* are formed at the positions corresponding to the positions where the positioning marks 28*a* are provided on the green sheets 21*a*, 21*c*, and 21*e*. The surface electrodes 30 and 31 are printed on the piezoelectric green sheet for the piezoelectric sheet 23.

Next, in S30, the plurality of piezoelectric green sheets are stacked one on another so that the piezoelectric green sheets for the piezoelectric sheets 22, 21*a*–21*g*, and 23 are stacked in this order.

Next in S40, the stacked piezoelectric green sheets are degreased and sintered to form the piezoelectric actuator 20. Then, the through-holes 32 and 33 are formed through the piezoelectric actuator 20, and conductive material is filled in the through-holes 32 and 33. The adhesive sheet is attached to the bottom surface of the piezoelectric actuator 20.

Next, in S50, as shown in FIG. 10, the light source 91 is driven to radiate a light beam 91*a* onto the piezoelectric actuator 20 in the stacked direction, thereby causing each positioning mark 28*a* to form a shadow 28*c* as shown in FIG. 11.

In S60, the light receiving device 92 is driven to receive the light beam 91*a*, thereby picking up an image of the three shadows 28*c* at each corner.

In S70, an image processing device, such as a personal computer, is controlled to calculate the position of the darkest portion of the three shadows 28*c* at each corner, thereby determining the position of the center of gravity of the three shadows 28*c* at each corner. The image processing device further calculates the position of the center of gravity P of the shadows 28*c* at all the four corners.

In S80, an imaging device is controlled to pick up an image of the positioning marks 14*a* on the cavity unit 10.

In 90, the image processing device is controlled to calculate the position of the center of gravity Q for the four positioning marks 14*a* as shown in FIG. 5.

In S100, a jig holding the piezoelectric actuator 20 and another jig holding the cavity unit 10 are moved relative to each other so that the center of gravity P of the piezoelectric actuator 20 coincides with the center of gravity Q of the cavity unit 10.

In S110, after the center of gravity P is aligned with the center of gravity Q, the piezoelectric actuator 20 is bonded to the cavity unit 10 via the adhesive sheet.

Next, in S120, the flexible flat cable 40 is disposed on the top surface of the piezoelectric actuator 20. Various wiring patterns in the flexible flat cable 40 (not shown) are electrically bonded to the surface electrodes 30 and surface electrodes 31.

In this way, the inkjet print head 6 of the present embodiment is produced.

By applying voltages across arbitrary individual electrodes 24 and the common electrodes 25 in the piezoelectric actuator 20, deformation in the stacking direction is generated in parts of the piezoelectric sheets corresponding to the individual electrodes 24, to which the voltages are applied. As a result, ink in the pressure chambers 16 corresponding to these individual electrodes 24 is ejected from the corresponding nozzles 15 in the form of ink droplets.

In this way, voltages applied to the individual electrodes 24 in the piezoelectric actuator 20 cause deformation of the piezoelectric sheets having those individual electrodes 24. This deformation is transferred to the corresponding pressure chambers 16 in the cavity unit 10, causing ink to eject from nozzles 15 corresponding to the pressure chambers 16. In the process of manufacturing the piezoelectric actuator 20, the piezoelectric sheets shrink during the sintering step, changing the pitch between individual electrodes 24 formed on these sheets. However, according to the present embodiment, the positions of the individual electrodes 24 can be accurately detected by irradiating light 91*a* in the stacked direction of the piezoelectric sheets onto the positioning marks 28*a* formed on the piezoelectric sheets.

As described above, according to the present embodiment, the inkjet print head 6 includes the piezoelectric actuator 20, which is configured from stack of the plurality of piezoelectric sheets 21*a*–21*g*, 22, and 23. The individual electrodes 24 are formed on the piezoelectric sheets 21*a*, 21*c*, and 21*e*. The positioning marks 28*a* are made of the same material as the individual electrodes 24, and are formed in each of the four corners of the piezoelectric sheets 21*a*, 21*c*, and 21*e*. A beam of light is radiated on the positioning marks 28*a* in the stacked direction of the piezoelectric sheets, forming shadows 28*c* of the positioning marks in each corner. The shadows are detected, and the center of gravity is determined for the shadows 28*c* at each corner. Diagonal lines are drawn between the centers of gravity in opposing corners. The intersecting point P of the diagonal lines serves as a reference point for bonding the piezoelectric actuator 20 to the cavity unit 10. It is possible to assemble the piezoelectric actuator 20 and the cavity unit 10 while forming a precise correspondence between the individual electrodes 24 and the pressure chambers 16.

In the inkjet print head 6 described above, the positioning marks 28*a* are provided on the piezoelectric sheets 21*a*, 21*c*, and 21*e* to be used for sensing the position of individual electrodes 24 using light 91*a* radiated in the stacking direction of the sheets. Accordingly, it is possible to determine the positions of the individual electrodes 24 even when the piezoelectric sheets 21*a*–21*g*, 22, and 23 shrink during the sintering process. The individual electrodes 24 in the piezoelectric actuator 20 can be accurately aligned with the pressure chambers 16 in the cavity unit 10 when assembling the piezoelectric actuator 20 to the cavity unit 10.

The positioning marks 28*a* are configured as marks, and are formed at the same time and of the same material as the individual electrodes 24 on the piezoelectric sheets 21*a*, 21*c*, and 21*e*. Accordingly, the marks 28*a* can accurately reflect or indicate the position of the individual electrodes 24. Further, the positioning marks 28*a* can easily be provided on the piezoelectric sheets.

Two positioning marks 28*a* are provided on the both ends of each row of individual electrodes 24. Accordingly, it is possible to detect an average position of the individual electrodes 24 along the row of the individual electrodes 24. The two rows of individual electrodes 24 are separated from the each other in the widthwise direction on the piezoelectric sheet. Accordingly, by using the positioning marks 28*a* on the ends of the two rows of individual electrodes, it is possible to attain the accurate detection of a center of gravity for the positioning marks 28*a*.

The common electrodes 25 are not formed at positions corresponding to the positioning marks 28*a*, thereby not blocking a light beam 91*a* that is radiated on the positioning marks 28*a* and that bears thereon the shadows 28*c* of the positioning marks 28*a*.

While the invention has been described in detail with reference to the specific embodiment thereof, it would be apparent to those skilled in the art that various changes and modifications may be made therein without departing from the spirit of the invention.

For example, in the embodiment described above, the positioning marks 28*a* are provided in the four corners of the piezoelectric sheet 21*a* and the like. However, the positioning marks 28*a* can be provided in only three corners instead. In this case, two positioning marks 28*a* are provided on both ends of one row of individual electrodes 24. By the two positioning marks 28*a*, it is possible to detect an average position of the individual electrodes 24 in the lengthwise direction of the piezoelectric sheet along the rows of the individual electrodes 24. The third positioning mark 28*a* is additionally provided at a position that is separated from the first two positioning marks 28*a* in the widthwise direction of the piezoelectric sheet. It is possible to attain the accurate detection of a center of gravity for the three positioning marks 28*a*.

No through-holes 32 or no through-holes 33 may be formed in the actuator plate 20. In this modification, the extended parts 25*a* on all the common electrodes 25 are exposed on one side of the piezoelectric actuator 20. A connecting electrode (not shown) is provided across the entire thickness direction of the piezoelectric actuator 20 to connect all the common electrodes 25 in the stacked direction. These connecting electrodes are electrically connected to one of the surface electrodes 31 on the top sheet 23. Similarly, the ends of the individual electrodes 24 are exposed on one side surface of the piezoelectric actuator 20. Connecting electrodes (not shown) connecting individual electrodes 24 at the corresponding positions are provided to the side surface of the piezoelectric actuator 20. These connecting electrodes can also be electrically connected to the corresponding surface electrodes 30 on the top sheet 23. When providing the connecting electrodes on the side surface of the piezoelectric actuator 20 in this way, these electrodes are formed after sintering.

What is claimed is:

1. An inkjet print head comprising:

a cavity unit having a plurality of nozzles and a plurality of pressure chambers which are provided in one-to-one correspondence with the plurality of nozzles; and a piezoelectric actuator provided over the cavity unit, the piezoelectric actuator including:

a plurality of piezoelectric sheets which are stacked one on another, each piezoelectric sheet being elongated over the plurality of pressure chambers;

a plurality of individual electrodes provided on each of several ones of the plurality of piezoelectric sheets; and at least one detecting portion, formed on each of the several piezoelectric sheets, for being used to detect the position of the individual electrodes by being irradiated with light along the stacked direction of the piezoelectric sheets, the piezoelectric actuator and the cavity unit being positioned relative to each other using the at least one detecting portion on each of the several piezoelectric sheets, thereby allowing each individual electrode to be located substantially at a position corresponding to one pressure chamber.

2. An inkjet print head as recited in claim 1, wherein the cavity unit is provided with at least one cavity-unit detecting portion, the piezoelectric actuator and the cavity unit being positioned relative to each other with a center of gravity position of the at least one detecting portion being located coincident with a center of gravity position of the at least one cavity-unit detecting portion.

3. An inkjet print head as recited in claim 1, wherein the plurality of piezoelectric sheets are made of material that transmits light therethrough, and wherein each of the at least one detecting portion is made of material that blocks light to form a shadow when irradiated with light, the position of the shadow being detected to indicate the position of the individual electrodes.

4. An inkjet print head as recited in claim 1, wherein the at least one detecting portion on each of the several piezoelectric sheets includes one detecting portion that is located substantially at a predetermined single position along the stacked direction, the one detecting portion on the same predetermined position on the several piezoelectric sheets being irradiated with light along the stacked direction to form several shadows which are overlapped with one another, the darkest portion in the overlapped region of the shadows being detected to indicate the position of the individual electrodes on the several piezoelectric sheets.

5. An inkjet print head as recited in claim 1, wherein each of the at least one detecting portion, formed on each of the several piezoelectric sheets, includes at least one mark, which is formed on the corresponding piezoelectric sheet at the same time as the individual electrodes are formed on the corresponding piezoelectric sheet and which is made of the same material used to form the individual electrodes.

6. An inkjet print head as recited in claim 5, wherein each piezoelectric sheet is of a rectangular shape elongated in a lengthwise direction and has a pair of first sides and a pair of second sides, the first sides being elongated in the lengthwise direction and longer than the second sides, the individual electrodes being arranged in at least one row along at least one first side of the piezoelectric sheets, and wherein the at least one detecting portion, formed on each of the several piezoelectric sheets, includes two detecting portions which are located on both ends of the at least one row of individual electrodes on the corresponding piezoelectric sheet.

7. An inkjet print head as recited in claim 6, wherein the two detecting portions, formed on each of the several piezoelectric sheets, produce two shadows when being irradiated with light, the average position of the two shadows in the lengthwise direction of the piezoelectric sheets being detected to indicate the position of the individual electrodes along the lengthwise direction.

8. An inkjet print head as recited in claim 6, wherein the cavity unit is of a rectangular shape extending along a lengthwise direction and having a pair of first sides and a pair of second sides, the first sides beig elongated in the lengthwise direction and longer than the second sides, the pressure chambers are arranged in at least one row along the lengthwise direction of the cavity unit, the piezoelectric actuator being provided over the cavity unit with the lengthwise direction of the piezoelectric actuator being substantially parallel to the lengthwise direction of the cavity unit, and wherein the cavity unit is provided with two cavity-unit detecting portions which are arranged along the lengthwise direction of the cavity unit, the piezoelectric actuator and the cavity unit being positioned relative to each other with an average position of the two detecting portions being substantially coincident with an average position of the two cavity-unit detecting portions.

9. An inkjet print head as recited in claim 6, wherein the at least one detecting portion, formed on each of the several piezoelectric sheets, includes at least one additional detecting portion which is located at a position that is separated in the widthwise direction of the corresponding piezoelectric sheet from the two detecting portions.

10. An inkjet print head as recited in claim 9, wherein the at least one additional detecting portion, formed on each of the several piezoelectric sheets, produces one additional shadow when being irradiated with light, the average position of the one additional shadow and the two shadows in the widthwise direction of the piezoelectric sheets being detected to indicate the position of the individual electrodes along the widthwise direction.

11. An inkjet print head as recited in claim 9, wherein the individual electrodes are arranged in two rows along two first sides of the piezoelectric sheets, and wherein the at least one detecting portion, formed on each of the several piezoelectric sheets, includes four detecting portions which are located on both ends of the two rows of individual electrodes on the corresponding piezoelectric sheet.

12. An inkjet print head as recited in claim 11, wherein the four detecting portions, formed on each of the several piezoelectric sheets, produce four shadows when being irradiated with light, one intersection between two diagonal lines that connect the four shadows being detected to indicate, as a center of gravity of the four detecting portions, the positions of the individual electrodes.

13. An inkjet print head as recited in claim 12, wherein the cavity unit is of a rectangular shape having four corners, the cavity unit being provided with four cavity-unit detecting portions at the four corners, and wherein the piezoelectric actuator and the cavity unit are positioned relative to each other with the center of gravity of the four detecting portions being coincident with the center of gravity of the four cavity-unit detecting portions.

14. An inkjet print head as recited in claim 6, wherein at least one remaining piezoelectric sheet other than the several piezoelectric sheets is provided with a common electrode that extends along the at least one row of individual electrodes and that is located at a position shifted from the at least one detecting portion.

15. An inkjet print head as recited in claim 14, wherein the plurality of piezoelectric sheets include:

several first piezoelectric sheets, each first piezoelectric sheet being provided with the plurality of individual electrodes and at least two dummy electrodes; and remaining several second piezoelectric sheets, each second piezoelectric sheet being provided with a common electrode and at least two additional dummy electrodes, wherein the plurality of individual electrodes, formed on each first piezoelectric sheet, are arranged in at least one row, each of the at least two dummy electrodes being located at a corresponding end of the corresponding row of individual electrodes, each dummy electrode being divided into first, second, and third sections, which are separated from one another with a first gap being formed between the first and second sections and a second gap being formed between the second and third sections, the second section of each dummy electrode serving as one of the at least one detecting portion, and wherein a third gap is formed between the common electrode and each of the at least two additional dummy electrodes, at a position that corresponds to the second section of the corresponding dummy electrode, the third gap having an area substantially greater than or equal to a total area of the corresponding second section and the corresponding first and second gaps, the light irradiated on the entire region of each second section and its corresponding first and second gaps along the stacked direction passes through the corresponding third gap to form a shadow of the second section.

16. An inkjet print head comprising:

a cavity unit having a plurality of nozzles and a plurality of pressure chambers which are provided in one-to-one correspondence with the plurality of nozzles; and a piezoelectric actuator provided over the cavity unit, the piezoelectric actuator including:

a plurality of piezoelectric sheets which are stacked one on another, each piezoelectric sheet being elongated over the plurality of pressure chambers;

a plurality of individual electrodes provided between at least two adjacent ones of the plurality of piezoelectric sheets; and at least one detecting portion, formed on at least one of the plurality of piezoelectric sheets, for being used to detect the position of the individual electrodes by being irradiated with light along the stacked direction of the piezoelectric sheets, the piezoelectric actuator and the cavity unit being positioned relative to each other using the at least one detecting portion, thereby allowing each individual electrode being located substantially at a position corresponding to one pressure chamber.

17. An inkjet print head, comprising:

a cavity unit which is elongated in a lengthwise direction, the cavity unit having a plurality of pressure chambers arranged in one row, the cavity unit being provided with two cavity-unit detecting portions, which are arranged along the lengthwise direction and which are located on both ends of the elongated cavity unit in the lengthwise direction; and a piezoelectric actuator provided over the cavity unit, the piezoelectric actuator including:

a plurality of piezoelectric sheets, a plurality of groups of individual electrodes, and a plurality of common electrodes, which are alternately stacked on one another, each piezoelectric sheet being elongated over the plurality of pressure chambers, each common electrode being elongated over the plurality of pressure chambers, each group of individual electrodes including a plurality of individual electrodes which are arranged in one row in one to one correspondence with the plurality of pressure chambers; and two detecting portions, formed on at least one of the plurality of piezoelectric sheets at two positions that are located on both ends of the row of the individual electrodes and that are shifted from the common electrodes, for being used to detect the position of the individual electrodes by being irradiated with light along the stacked direction, the piezoelectric actuator and the cavity unit being positioned relative to each other with an average position of the two detecting portions being substantially coincident with an average position of the two cavity-unit detecting portions, thereby allowing each individual electrode being located substantially at a position corresponding to one pressure chamber.

18. An inkjet print head as recited in claim 17, wherein the cavity unit is of a rectangular shape having tour corners, the cavity unit being provided with four cavity-unit detecting portions at the four corners, wherein the plurality of pressure chambers are arranged in two rows, wherein the plurality of individual electrodes are arranged in two rows in one to one correspondence with the two rows of pressure chambers, and wherein four detecting portions are formed on at least one of the plurality of piezoelectric sheets at four positions that are located on both ends of the two rows of the individual electrodes and that are shifted from the common electrodes, the four detecting portions producing four shadows when being irradiated with light along the stacked direction, one intersection between two diagonal lines that connect the tour shadows being detected to indicate, as a center of gravity of the four detecting portions, the positions of the individual electrodes, wherein the piezoelectric actuator and the cavity unit are positioned relative to each other with the center of gravity of the four detecting portions being coincident with the center of gravity of the four cavity-unit detecting portions, thereby allowing each individual electrode being located substantially at a position corresponding to one pressure chamber.

19. A method of producing an inkjet print head, the method comprising the steps of:

preparing a cavity unit, which is provided with a plurality of pressure chambers and which is formed with at least one cavity-unit detecting portion;

preparing a plurality of green sheets, for a plurality of piezoelectric sheets, from piezoelectric material that transmits light therethrough upon irradiation with the light;

printing a plurality of individual electrodes and at least one detecting portion on each of several ones of the plurality of piezoelectric green sheets and printing a common electrode on each of the other remaining piezoelectric green sheets at a position that is shifted from the position where the at least one detecting portion is printed on the several piezoelectric green sheets, the at least one detecting portion and the individual electrodes being made of the same material that blocks light when irradiated with light;

stacking the plurality of piezoelectric green sheets one on another;

sintering the stacked piezoelectric green sheets to form a piezoelectric actuator;

radiating light onto the piezoelectric actuator in the stacked direction, thereby causing each detecting portion to form a shadow, picking up at least one image of the at least one shadow, to obtain information on the position of the at least one detecting portion;

picking up an image of the at least one cavity-unit detecting portion on the cavity unit, to obtain information on the position of the at least one cavity-unit detecting portion;

positioning the piezoelectric actuator and the cavity unit relative to each other based on the information on the position of the at least one detecting portion and on the position of the at least one cavity-unit detecting portion, thereby allowing each individual electrode to be positioned in correspondence with a corresponding pressure chamber; and bonding the piezoelectric actuator and the cavity unit relative to each other.

20. A method as claimed in claim 19, wherein the cavity unit is formed with four cavity-unit detecting portions at its four corners, wherein four detecting portions are printed on four corners of each of the several piezoelectric sheets, wherein the shadow-image picking up step picks up images of four shadows formed by the four detecting portions, and obtains information on the position of a center of gravity of the piezoelectric actuator, wherein the cavity-unit-detection-image picking up step picks up images of the four cavity-unit detecting portions, and obtains information on the position of a center of gravity of the cavity unit, wherein the piezoelectric actuator and the cavity unit are relative to each other with the center of gravity of the piezoelectric actuator being located coincident with the center of gravity of the cavity unit.

21. A method as recited in claim 20, wherein the light-radiating step produces, at each of the four corners, several shadows which are produced by the detecting portions located on the corresponding corner on is the several piezoelectric green sheets and which are overlapped with one another, and wherein the shadow-image picking up step obtains information on the position of the darkest portion at each corner, and obtains information on the center of gravity of the positions of the darkest portions at the four corners as indicative of the center of gravity of the piezoelectric actuator.

* * * * *